United States Patent [19]

Rappinger

[11] 4,121,043

[45] Oct. 17, 1978

[54] PREHEATING METALLURGICAL ENCLOSURES

[75] Inventor: Bo Vesteras Rappinger, Vesteras, Sweden

[73] Assignee: Asea Aktiebolag, Vesteras, Sweden

[21] Appl. No.: 790,946

[22] Filed: Apr. 26, 1977

[30] Foreign Application Priority Data

May 24, 1976 [SE] Sweden ..... 7605840

[51] Int. Cl.[2] ..... F27D 23/00

[52] U.S. Cl. ..... 13/34; 13/35

[58] Field of Search ..... 13/1, 9, 10, 35, 34

[56] References Cited

U.S. PATENT DOCUMENTS

| | | | |
|---|---|---|---|
| 1,220,839 | 3/1917 | Gray | 13/35 |
| 2,133,329 | 10/1938 | Moore et al. | 13/35 |
| 2,156,608 | 5/1939 | Schon | 13/35 |

*Primary Examiner*—R. N. Envall, Jr.

*Attorney, Agent, or Firm*—Kenyon & Kenyon, Reilly, Carr & Chapin

[57] ABSTRACT

A method for preheating metallurgical enclosures having refractory linings which after preheating are exposed to the heat of molten metal, is effected by forming an electric open arc producing arc radiation at a location inside of such an enclosure exposing its lining directly to the arc radiation.

9 Claims, 3 Drawing Figures

PREHEATING METALLURGICAL ENCLOSURES

BACKGROUND OF THE INVENTION

Metallurgical enclosures such as molten metal ladles, removable furnace roofs, as exemplified by the roof of a typical electric arc furnace, and other metallurgical enclosures or containers, are characteristically built with a steel shell containing a refractory lining normally constructed from refractory bricks. They are characterized generally by the fact that their linings are exposed either directly by contact or via radiation to the heat of molten metal and are customarily preheated prior to such exposure.

One universal reason for such preheating is to reduce as much as possible the thermal shock that the refractory lining would experience if exposed when cold to the heat of the molten metal. In addition, there may be other reasons for resorting to preheating.

For example, when a steel making or finishing furnace is tapped, the molten steel is poured into a ladle which is carried to a casting location, the steel cooling during transport, possibly to a temperature too low for casting. Additional cooling in the ladle may be caused by additional processing of the steel in the ladle. Compensation for ladle heat losses can be made by a compensating temperature increase of the steel in the steel making or processing furnace, but this involves furnace temperatures which are higher than is desirable from the viewpoint of desirably long furnace lining life. Preheating of the steel ladle can reduce heat loss while the steel is in the ladle and thus reduce the otherwise required high furnace operating temperature.

Heretofore the most effective preheating means has been the burning of gas flames within the enclosure being preheated. This has well-known objections. For example, a refractory lining cannot be preheated much above 1200° C., the burnt gases must be exhausted from the preheating enclosure, thus resulting in heat waste and exhaust and dust problems, and because the flames usually operate in a fluttering manner, there is an uneven supply of heat and noise problem involved. Electric resistance heating has been proposed, but that practice is necessarily limited to drying a newly installed refractory lining. This follows from the fact that electric resistance heaters cannot radiate a great amount of heat.

It follows that the metallurgical industry has for a long time been confronted by the problem of preheating refractory lined furnace parts which when put into service are exposed to extremely high temperatures such as by actual contact of molten metal such as steel, radiation from molten steel and, in the case of an electric arc furnace roof, radiation from not only the molten metal but the arc as well.

SUMMARY OF THE INVENTION

According to the present invention, the above problem is solved by forming an electric open arc producing arc radiation at a location inside of the refractory lined enclosure exposing its lining directly to that radiation. An electric arc can produce extremely intense radiation which can cover the entire lining of the enclosure being preheated. The enclosure can be sealed shut gas-tightly and filled with gas that is inert with respect to the lining, the enclosure can be evacuated, and the enclosure can be filled with a reducing gas, all depending on the characteristics of the lining being preheated by the arc radiation. In all such instances an electric arc can be struck and maintained between two or more electrodes positioned on the inside of the enclosure being preheated.

A steel ladle can be reused a number of times before it must be relined and as for each reuse it whould be preheated to avoid the thermal shock which would otherwise occur when it receives a charge of molten steel. In some cases the ladle lining may contain frozen steel of slag or both.

One important use for the present invention is in connection with reused steel ladles. In such a case the ladle can be inverted on a refractory surface with which the ladle rim is sealed substantially gas tightly, the surface providing for two upstanding carbonaceous electrodes which when supplied with arcing power, provide the arc inside of the ladle. With the ladle initially containing air, the carbonaceous electrodes burn and produce a reducing gas in the form of CO. The gas, plus the high temperatures attainable by radiation of the arc to the ladle lining, can melt any excessive frozen steel in the ladle while reducing metal oxides of frozen slag to their metallic components which penetrate the lining and increase its serviceability for holding molten steel subsequently poured into the ladle. As an alternate procedure, the interior of the ladle may be filled with a reducing gas separate from that which might be formed by burning of the carbonaceous electrode. If no reaction is desired, the inverted ladle can be kept filled with a gas which is inert with respect to the ladle's contents, including its lining. If the surface on which the ladle is inverted is formed by a declining surface, anything melted from inside the ladle's lining can flow away as by forming the ladle with a suitable opening on its lower side.

It follows that with this open arc radiation technique, a number of heating procedures are opened up which are completely unavailable when gas flame heating is used. The ladle lining can be heated for all practical purposes to any temperature desired.

In the case of an electric arc furnace roof that is removable along with its two or more graphite arcing electrodes, the roof when removed can be positioned to cover the rim of a refractory bowl having a carbon electrode in its bottom. Then one of the usual graphite arcing electrodes can be lowered to contact this bottom electrode while one of the other normal graphite electrodes is spaced from the bottom electrode, whereby by the use of arcing electric power applied to the two normal arcing electrodes, an arc may be struck between the bottom electrode and the one of the electrodes that is spaced from this bottom electrode. In this way the furnace roof can be brought to a high temperature by the arc radiation so that when replaced on the electric arc furnace with its graphite electrodes arcing in their usual manner within the furnace, there is no possibility of the furnace roof lining receiving any substantial thermal shock.

BRIEF DESCRIPTION OF THE DRAWINGS

The accompanying drawings schematically illustrate various possibilities made practical by the present invention, the various figures being as follows.

DETAILED DESCRIPTION OF THE INVENTION

Figure 1:
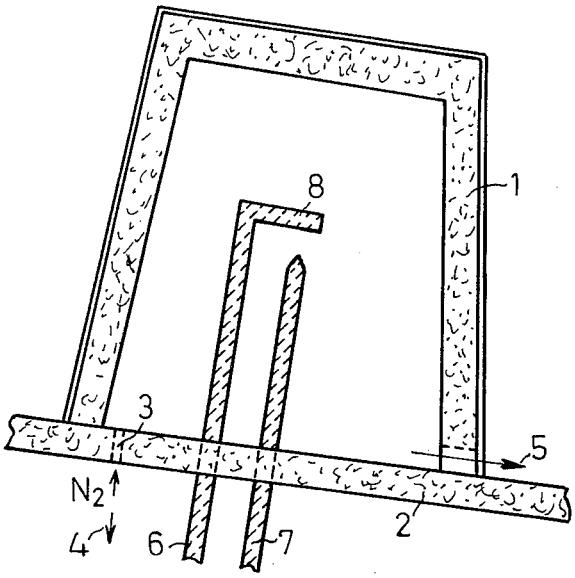
FIG. 1 in vertical section shows a steel ladle being preheated by the arc radiation.

Having reference first to FIG. 1, a previously used steel ladle 1 is shown inverted on a declining refractory surface 2 to which the rim of the ladle may be sealed in any practical manner. A passage 3 is formed through the surface 2 for the introduction of gases to the inside of the ladle, as indicated by the arrow 4, if desired, and the ladle is shown as having a notch in its rim on its low side and through which molten material may flow as indicated by the arrow 5. Carbonaceous electrodes 6 and 7 project up through the surface 2 to a central position inside of the ladle 1, the electrode 6 having a right angular extension 8 spaced above the tip of the electrode 7. When supplied with electric arcing power in the neighborhood of 500 v or less, the electrode 7 can be raised to strike an arc with the extension 8 and then lowered to the degree maintaining the arc. The resulting arc radiation strikes the entire inside of the lining of the ladle 1, heating the lining to almost any degree desired.

In FIG. 1 nitrogen gas is shown as being introduced via the passage 3, the opening indicated at 5 being either sealed or left open so that the nitrogen can flow until the interior of the inverted ladle is completely filled with the gas. In this case the nitrogen functions as in inert gas and any frozen slag or steel remaining in the ladle becoming molten and falling onto the surface 2 for ultimate withdrawal via 5.

If the gas introduced at 3 is reducing, or if burning of the arcing electrodes is relied on to feed the ladle with a reducing gas, under the radiation heating of the arc radiation remaining steel will be melted to fall on the surface 2 while the slag will be reduced to its metallic components, assuming the slag is a metal oxide, and this reduced metal will penetrate the refractory lining of the ladle so as to provide an increase in what would otherwise be the refractory's normal service life. It is undesirable to leave a fluxing slag in the ladle and by this reduction technique this type of slag can be eliminated.

As previously suggested, the arcing voltage should be below 500 v. Either AC or DC may be used to power the arc. The arcing electrodes can, of course, be made movable by externally applied motion, if required to assure uniform heating of the ladle lining.

Figure 2:
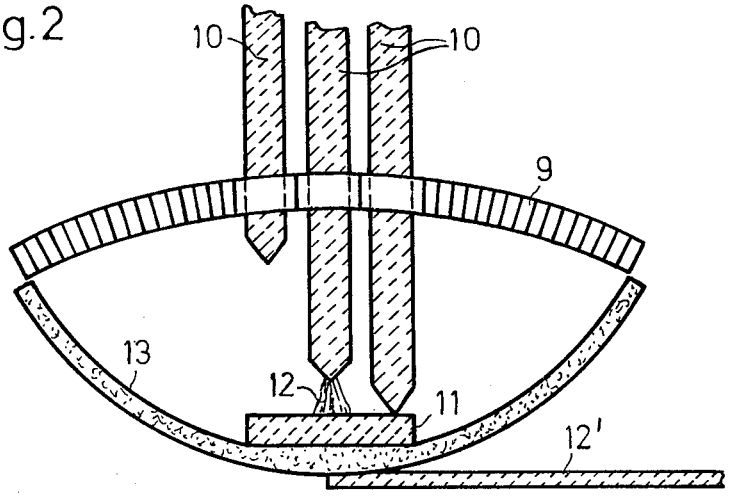
FIG. 2 in vertical section shows an electric arc furnace roof with its three normal working graphite electrodes, positioned over the refractory bowl with the preheating arc formed as previously suggested.

FIG. 2 serves to show an example where a conventional multi-phase AC arc furnace, normally having a roof that is removable along with its three graphite electrodes, is being preheated.

The roof 9 with its three electrodes 10 is shown positioned over a refractory bowl 13 with the two parts arranged rim to rim and the rims sealed if desired. The bottom of the bowl contains a graphite electrode 11 and, as can be seen, the normal electrode on the right has been lowered to make electrical contact with this bottom electrode 11, while one of the other electrodes has been lowered and then raised to strike the arc 12, those two of the three normal electrodes being, of course, suitably powered with arcing current. If this procedure is not desired, the bottom electrode 11 can be externally powered as indicated by the power line 12' so that only one of the three normal electrodes is required for maintaining the arc.

In the above practice the arc radiation, possibly reflected by the inside of the refractory bowl 13, can reach all portions of the lining of the removed furnace roof 9 so the latter is preheated in just about the same fashion that it will receive arc radiation when the cover is returned to the furnace along with its three arcing electrodes and the furnace is put back in operation.

Figure 3:
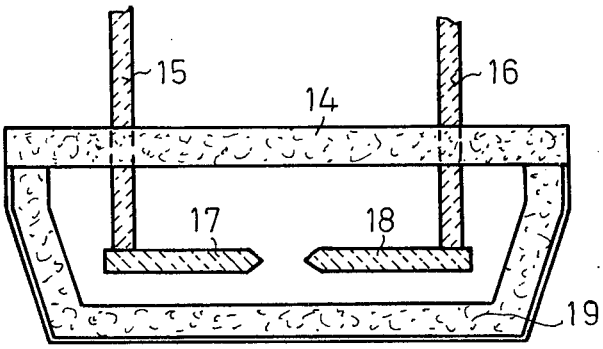
FIG. 3 in vertical section shows how even a shape casting mold can be preheated by the practice of the present invention.

FIG. 3 serves to show the use of a refractory lid 14 through which two electrodes 15 and 16 are positioned with graphite electrodes 17 and 18 arranged tip to tip so that an arc can be struck between them, the lid or cover 14 being positioned on the rim of a shape casting mold 19 which like the ladle and the furnace roof has a refractory lining, desirably preheated.

The present invention has particular value when used to preheat a steel ladle whether or not previously used. Ladles for containing molten steel normally are made with a steel shell lined with refractory bricks. Using a crane, the ladle can be inverted on a suitable refractory surface up through which two or more graphite arcing electrodes project so that they are centrally positioned inside of the ladle lining. Being thus enclosed, the ladle interior conditions can be maintained as desired, using either an inert gas, a reducing gas, or even evacuation. With the electrode suitable powered by adequate electric current maintaining the arc inside of the ladle, almost any degree of preheating may be applied to the ladle's lining. Because an electric arc is involved, the conditions inside of the ladle can have any characteristics desired.

In all possible applications of the present invention, the many disadvantages of gas flame heating are completely avoided. The attainable lining temperatures are far beyond that made possible by electric resistance heating techniques.

A furnace roof or steel ladle using a basic lining is normally impractical because when cooling from a high temperature the basic bricks decompose and settle. Using the technique of the present invention, when an electric furnace roof having a basic lining is swung aside carrying its arcing electrodes, as is done, for example, to charge the furnace with large pieces of scrap, it can be lowered onto the refractory bowl rim as previously described, and then by promptly striking and maintaining the arc as previously described, the roof's basic brick lining can be kept at substantially the same temperature as is encountered during the normal furnace operation. There is no chance for the lining to cool. In the case of the steel ladle, after the ladle is emptied from molten steel by casting of the latter, the ladle can be crane carried promptly to the surface 2 where the ladle is inverted and the previously described arc promptly started and maintained. In this way a ladle using a basic brick lining can be kept at a temperature high enough to maintain the integrity of the lining and, of course, for preheating to receive a next charge of steel when the ladle is returned to service.

What is claimed is:

1. A method for preheating a metallurgical enclosure having a refractory lining which after preheating is exposed to the heat of molten metal, said method comprising enclosing said lining in a substantially gas-tight manner and forming an electric open arc producing arc radiation at a location inside of said enclosure so as to expose said lining directly to said radiation.

2. The method of claim 1 in which said enclosure is a ladle previously used to contain molten steel and into which steel is to be poured after said preheating, the ladle being inverted during said preheating and the arc radiation being made intense enough to heat the ladle's lining so as to melt any solidified slag and steel remaining in the ladle from its previous use.

3. The method of claim 2 in which said ladle is inverted on a surface sealing the ladle substantially gas-tightly during said preheating.

4. The method of claim 3 in which said ladle is filled with an inert gas while sealed by said surface and during said preheating.

5. The method of claim 3 in which said ladle is filled with a reducing gas while sealed by said surface during said preheating so that metal oxides remaining in the ladle's lining are reduced to metals.

6. The method of claim 3 in which said surface declines.

7. The method of claim 5 in which said arc is formed by carbonaceous electrodes which burn and form said reducing gas.

8. The method of claim 1 in which said enclosure is an electric arc furnace roof having at least one arcing electrode connected therewith for use in a furnace having said roof, said arc being formed via said electrode.

9. The method of claim 8 in which said roof has at least two electrodes and is positioned over a refractory bowl having an electrically conductive bottom element, one of said electrodes being lowered to make electrical contact with said element and the other being positioned to maintain said arc with said element.

* * * * *